US008557061B2

(12) United States Patent
Yoshihara

(10) Patent No.: US 8,557,061 B2
(45) Date of Patent: Oct. 15, 2013

(54) SPRING STEEL WITH EXCELLENT RESISTANCE TO HYDROGEN EMBRITTLEMENT AND STEEL WIRE AND SPRING OBTAINED FROM THE STEEL

(75) Inventor: Nao Yoshihara, Kobe (JP)

(73) Assignee: Kabushiki Kaisha Kobe Seiko Sho, Kobe-shi (JP)

( * ) Notice: Subject to any disclaimer, the term of this patent is extended or adjusted under 35 U.S.C. 154(b) by 737 days.

(21) Appl. No.: 11/538,703

(22) Filed: Oct. 4, 2006

(65) Prior Publication Data

US 2007/0095439 A1 May 3, 2007

(30) Foreign Application Priority Data

Nov. 2, 2005 (JP) ..... 2005-319641

(51) Int. Cl.
*C22C 38/28* (2006.01)

(52) U.S. Cl.
USPC ..... 148/333; 420/104

(58) Field of Classification Search
USPC ..... 148/332; 420/91
See application file for complete search history.

(56) References Cited

U.S. PATENT DOCUMENTS

| | | | | |
|---|---|---|---|---|
| 5,776,267 | A | 7/1998 | Nanba et al. | |
| 6,206,984 | B1 | 3/2001 | Inada et al. | |
| 6,372,056 | B1 | 4/2002 | Kuroda et al. | |
| 6,406,565 | B1 * | 6/2002 | Hashimura et al. | 148/333 |
| 2005/0173028 | A1 | 8/2005 | Suda et al. | |
| 2006/0225819 | A1 | 10/2006 | Yoshihara | |

FOREIGN PATENT DOCUMENTS

| | | |
|---|---|---|
| EP | 0 943 697 A1 | 9/1999 |
| EP | 1 698 712 A1 | 9/2006 |
| JP | 10-110247 | 4/1998 |
| JP | 10-287958 | 10/1998 |
| JP | 3219686 | 8/2001 |
| JP | 3429164 | 5/2003 |
| JP | 2005-23404 | 1/2005 |

OTHER PUBLICATIONS

Shin-Ichi Komazaki, et al, "Environmental Embrittlement of Automobile Spring Steels Caused by Wet-Dry Cyclic Corrosion in Sodium Chloride Solution", Corrsion Science, XP-005088800, vol. 47, No. 10, Oct. 2005, pp. 2450-2460.

Shimotsusa Masataka, et al, "Wire Rod for Suspension Spring With Excellent Corrosion Fatigue Life", Database Compendex, Database accession No. EIX97273647088, Engineering Information, XP-002409041, 1997, 1 Page.

U.S. Appl. No. 11/548,080, filed Oct. 10, 2006, Yoshihara, et al.

* cited by examiner

*Primary Examiner* — Jie Yang

(74) *Attorney, Agent, or Firm* — Oblon, Spivak, McClelland, Maier & Neustadt, L.L.P.

(57) ABSTRACT

Disclosed is a spring steel, containing: C: 0.35-0.65% (the term "%" herein means "mass %", the same is true hereinbelow), Si: 1.5-2.5%, Mn: 0.05-1%, Cr: 0.05-1.9%, P: 0.015% or less (exclusive of 0%), S: 0.015% or less (exclusive of 0%), Ti: 0.025-0.1%, Al: 0.05% or less (exclusive of 0%), and N: 0.01% or less (exclusive of 0%), wherein an amount of Ti nitride, an amount of Ti sulfide, and an amount of Ti carbide satisfy the following formulas (1), (2), and (3);

$$[Ti_{with\ N}] \geq 3.42 \times [N] - 0.354 \times [Al] - 0.103 \times [Nb] \quad (1)$$

$$[Ti_{with\ S}] \geq 1.49 \times [S] \quad (2)$$

$$[Ti_{with\ C}] \geq 0.015 \quad (3),$$

in which $[Ti_{with\ N}]$ represents the amount of Ti (mass %) forming Ti nitride, $[Ti_{with\ S}]$ represents the amount of Ti (mass %) forming Ti sulfide, $[Ti_{with\ C}]$ represents the amount of Ti (mass %) forming Ti carbide, and [N], [Al], [Nb], and [S] represent an amount (mass %) of each element in the steel. The spring steel of the present invention shows excellent resistance to hydrogen embrittlement.

10 Claims, 2 Drawing Sheets

SPRING STEEL WITH EXCELLENT RESISTANCE TO HYDROGEN EMBRITTLEMENT AND STEEL WIRE AND SPRING OBTAINED FROM THE STEEL

BACKGROUND OF THE INVENTION

1. Field of the Invention

The present invention relates to a spring steel with improved resistance to hydrogen embrittlement.

2. Description of the Related Art

The chemical compositions of spring steels are specified in JIS G3565 to 3567, G4801 and the like. By use of these spring steels, various springs are manufactured by the steps of: (1) hot-rolling each spring steel into a hot-rolled wire rod or bar (hereinafter, referred to as "rolled material"); and drawing the rolled material to a specified diameter and then cold forming the wire into a spring after oil-tempering; or (2) drawing the rolled material or peeling and straightening the rolled material, heating and forming the wire into a spring, and quenching and tempering it.

Recently, there have been strong demands toward the enhancement of the stress of a spring as a part of measures of achieving small and light springs in order to reduce exhaust gas or fuel consumption. For example, there is required a high strength spring steel of which strength after quenching and tempering is HRC52 or greater. However, as the strength of a spring is enhanced, the sensitivity against defects is generally increased. Particularly, since the high strength spring used in a corrosion environment is deteriorated in corrosion fatigue life, there is a possibility of causing an early breakage. It is being thought that the reason why corrosion fatigue life is reduced is that corrosion pits on the surface of a spring act as stress concentration sources which accelerate the generation and propagation of fatigue cracks. To prevent the reduction of corrosion fatigue life, corrosion resistance must be improved by the addition of elements such as Si, Cr and Ni. However, these elements are also effective to enhance quenching and tempering, and when used in large amounts they produce a supercooling structure (martensite, bainite, etc.) in the rolled material. This requires a softening heat treatment such as annealing before drawing the rolled material. Therefore, the number of processing steps is increased, leading to an increase in the manufacturing cost.

Recently, a technology for improving both corrosion fatigue characteristics and workability has been developed (U.S. Pat. No. 5,776,267). This proposes refining and dispersing fine precipitates of carbide, nitride, sulfides such as Ti, Zr, Ta, Hf and the like in a spring steel. This is so because the finely dispersed precipitates can trap diffusive hydrogen in the spring steel and suppress hydrogen from diffusing and carrying prior austenite grains, consequently preventing hydrogen embrittlement. According to this disclosure, when the prior austenite grain is 20 μm or smaller, the carbide, nitride, sulfide precipitating in a crystal grain boundary become extremely fine as well. This hardly exerts an adverse effect on toughness or fatigue property of the spring steel, but enhances diffusive hydrogen trapping.

Besides the above-described U.S. Pat. No. 5,776,267, other techniques for improving resistance to hydrogen embrittlement (Japanese Patent Publication Nos. 3429164 and 3219686 and Japanese Patent Laid-Open No. 2005-23404, etc.). Japanese Patent Publication No. 3429164 disclosed a method for improving resistance to hydrogen embrittlement by securing an amount of Ti carbo-nitride production by replacing S with CuS, knowing that the existence of S reduces an amount of Ti carbo-nitride production effective for hydrogen supplementation. Meanwhile, Japanese Patent Publication No. 3219686 disclosed a method for improving resistance to hydrogen embrittlement by reducing the formation of MnS based inclusions. It also teaches that the resistance to hydrogen embrittlement can be enhanced even more by reducing size and volume ratio provided that the same amount of MnS based inclusions was used. Lastly, according to Japanese Patent Laid-Open Publication No. 2005-23404, by suitably balancing the contents of Cr, Ti, and V, hydrogen infiltration into a spring steel can be prevented and thus, corrosion fatigue resistance of the spring steel is remarkably improved.

SUMMARY OF THE INVENTION

In view of the foregoing problems, it is, therefore, an object of the present invention to provide a technique for positively improving resistance to hydrogen embrittlement of a spring steel.

It is another object of the present invention to provide a high strength spring steel (steel wire or steel bar) with excellent resistance to hydrogen embrittlement although the spring steel does not contain an excessive amount of alloying elements such as Cr, Si, Ni and the like, and a steel wire or a spring that can be obtained from the corresponding spring steel.

To achieve the above-described objects and other advantages, the inventors continuously researched a method for improving the resistance to hydrogen embrittlement of a spring steel and finally discovered that the resistance to hydrogen embrittlement of a spring steel can be enhanced by replacing almost all dissolved S in a high-strength steel by Ti sulfide and dissolved N by Ti nitride, and by forming a sufficient amount of Ti carbide. They also found out that the resistance to hydrogen embrittlement of a spring steel was markedly improved when the following formulas (1), (2), and (3) were satisfied.

A spring steel of the present invention contains C: 0.35-0.65% (the term "%" herein means "mass %", the same is true hereinbelow), Si: 1.5-2.5%, Mn: 0.05-1%, Cr: 0.05-1.9%, P: 0.015% or less (exclusive of 0%), S: 0.015% or less (exclusive of 0%), Ti: 0.025-0.1%, Al: 0.05% or less (exclusive of 0%), and N: 0.01% or less (exclusive of 0%), wherein an amount of Ti in Ti nitride, an amount of Ti in Ti sulfide, and an amount of Ti in Ti carbide satisfy the following formulas (1), (2), and (3);

$$[Ti_{with\ N}] \geq 3.42 \times [N] - 0.354 \times [Al] - 0.103 \times [Nb] \quad (1)$$

$$[Ti_{with\ S}] \geq 1.49 \times [S] \quad (2)$$

$$[Ti_{with\ C}] \geq 0.015 \quad (3),$$

in which $[Ti_{with\ N}]$ represents the amount of Ti (mass %) forming Ti nitride, $[Ti_{with\ S}]$ represents the amount of Ti (mass %) forming Ti sulfide, $[Ti_{with\ C}]$ represents the amount of Ti (mass %) forming Ti carbide, and [N], [Al], [Nb], and [S] represent an amount (mass %) of each element in the steel.

The spring steel of the present invention may further contain at least one element selected from a group consisting of Cu: 0.7% or less (exclusive of 0%), Ni: 0.8% or less (exclusive of 0%), V: 0.4% or less (exclusive of 0%) and Nb: 0.1% or less (exclusive of 0%).

Another aspect of the present invention provides a steel wire and a spring which can be obtained from the spring steel.

In the steel of the present invention, dissolved S is changed into Ti sulfide and dissolved N is changed into Ti nitride, and the steel wire contains a sufficient amount of Ti carbide, thereby satisfying the formulas (1)-(3) and showing excellent resistance to hydrogen embrittlement. In addition, since the steel does not contain excessive amounts of alloying elements such as Cr, Si, Ni and the like, it provides superior workability.

DESCRIPTION OF THE PREFERRED EMBODIMENTS

Figure 1:
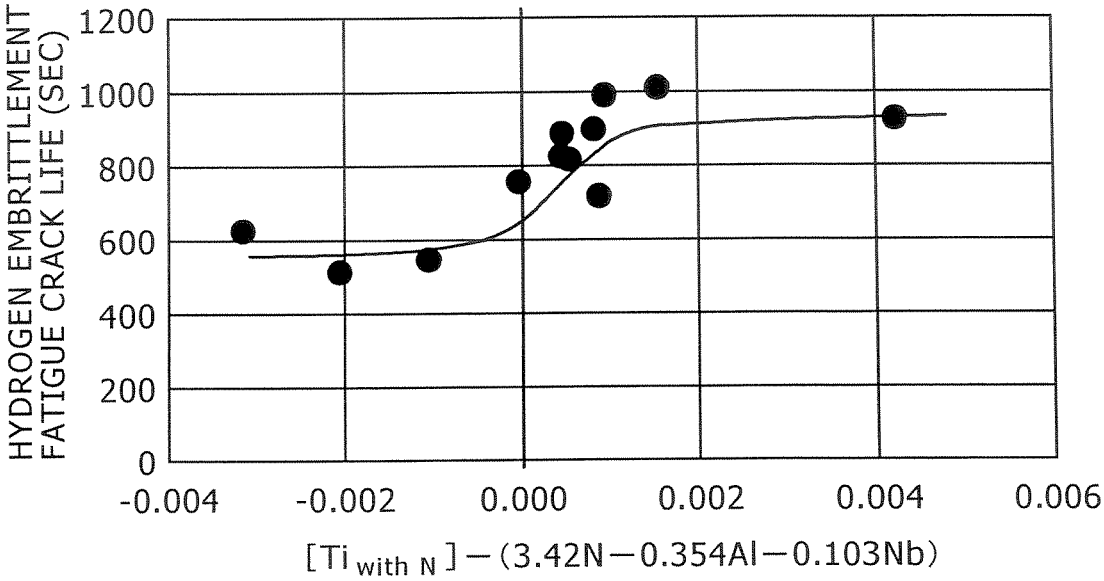
FIG. 1 is a graph showing a relation between a formula (1) and hydrogen embrittlement resistance.

First, the chemical composition of a spring steel of the present invention is explained. The spring steel of the present invention contains C: 0.35-0.65% (the term "%" herein means "mass %", the same is true hereinbelow), Si: 1.5-2.5%, Mn: 0.05-1%, Cr: 0.05-1.9%, P: 0.015% or less (exclusive of 0%), S: 0.015% or less (exclusive of 0%), Ti: 0.025-0.1%, Al: 0.05% or less (exclusive of 0%), and N: 0.01% or less (exclusive of 0%). The reason for specifying the chemical composition of the steel used in the present invention will now be described.

C: 0.35-0.65% (the term "%" herein means "mass %", the same is true hereinbelow)

C is an essential element in the steel for ensuring the tensile strength (hardness) after quenching and tempering. Accordingly, the lower limit of the C content is specified at 0.35%, preferably 0.40%, and more preferably 0.47%. When the C content is excessive, the toughness and ductility after quenching and tempering is deteriorated, and the corrosion resistance is also lowered. Therefore, the upper limit of the C content is specified at 0.65%, preferably 0.60%, and more preferably 0.54%.

Si: 1.5-2.5%

Si is an element for reinforcing the solid solution and contributes to the enhancement of strength of the steel. Accordingly, the lower limit of the Si content is specified at 1.5%, preferably 1.7%, and more preferably 1.8%. However, if the Si content is excessive, the solution of carbides becomes insufficient upon heating for quenching, and the uniform austenitizing requires the heating at a high temperature, which excessively accelerates the decarbonization on the surface, thereby deteriorating the fatigue characteristics of a spring. Therefore, the upper limit of the Si content is specified at 2.5%, preferably 2.3%, and more preferably 2.1%.

Mn: 0.05-1%

Mn is actively involved in enhancement of quenchability (hardenability) in the steel. To achieve this function, the lower limit of the Mn content is specified at 0.05%, preferably, 0.10%, and more preferably 0.15%. However, if the Mn content is excessive, the quenchability is excessively increased and a supercooling structure is generated upon rolling as the starting point of the fracture process. In addition, MnS based inclusions that deteriorate the resistance to hydrogen embrittlement are easily produced. Accordingly, the upper limit of the Mn content is specified at 1%, preferably 0.8%, and more preferably 0.5%.

Cr: 0.05-1.9%

Cr is an element to make amorphous and dense the rust produced on the surface layer in a corrosion environment, and serves to improve the corrosion resistance and the quenchability like Mn. Therefore, the lower limit of the Cr content is specified at 0.05%, preferably 0.1%, and more preferably 0.2%. However, if the Cr content is excessive, carbides are not easily dissolved during quenching, thereby deteriorating tensile strength of the steel. Accordingly, the upper limit of the Cr content is specified at 1.9%, preferably 1.5%, and more preferably 1.1%.

P: 0.015% or less (exclusive of 0%).

P is an element which segregates prior austenite grains and embrittles the grain boundary, thereby deteriorating the delayed fracture resistance (hydrogen embrittlement resistance). Therefore, the P content should be as low as possible such as 0.015% or less, preferably 0.010% or less, more preferably 0.008% or less.

S: 0.015% or less (exclusive of 0%)

S is an element which segregates prior austenite grains and embrittles the grain boundary, thereby deteriorating the delayed fracture resistance (hydrogen embrittlement resistance). Therefore, the S content should be as low as possible such as 0.015% or less, preferably 0.010% or less, more preferably 0.008% or less. However, when dissolved S is replaced by Ti sulfide, it traps hydrogen and thus, improves the resistance to hydrogen embrittlement. Therefore, the S content may be specified at 0.001% or more, preferably 0.002% or more, and more preferably 0.003% or more.

Ti: 0.025-0.1%

Ti is required for changing dissolved S to Ti sulfide and dissolved N to Ti nitride, and for precipitating a sufficient amount of Ti carbide. When the formulas (1) -(3) (to be described later) are satisfied as a result, hydrogen embrittlement resistance of the steel is markedly improved. Accordingly, the lower limit of the Ti content is specified at 0.025%, preferably 0.03%, and more preferably 0.04%. However, if the Ti content is excessive, coarse nitrides remain. Therefore, the upper limit of the Ti content is specified at 0.1%, preferably 0.09%, and more preferably 0.08%.

Al: 0.05% or less (exclusive of 0%)

Al is not an essential element but may be added as a deoxidizing agent. When used, it enhances toughness and further, sag resistance of the steel. Although not absolute, the lower limit of the Al content is specified at 0.001%, preferably 0.005%, and more preferably 0.01%. However, if too much Al is added, coarse oxide based inclusions are precipitated, adversely affecting the fatigue life. Therefore, the upper limit of the Al content is specified at 0.05%, preferably 0.045%, and more preferably 0.040%.

N: 0.01% or less (exclusive of 0%)

N is an element whose content is often restricted for purpose of avoiding the adverse effect of dissolved N. In general, the manufacturing process of springs includes shot peening treatment in its last step to reinforce the surface, and a low-temperature annealing process at 200-250° C. is also carried out to increase the resistance deteriorated due to shot peening and to reduce strain generated excessively by shot peening. When too much dissolved N is present during the low-temperature annealing process, free nitrogen gathers around plural dislocations multiply formed in the steel and the dislocations are fixed. This resultantly causes blue brittleness and deteriorates hydrogen embrittlement resistance. In addition, an excessive amount of Ti nitrides is produced or coarse Ti nitrides remain, thereby deteriorating durability of a spring. Accordingly, the upper limit of the N content is specified at 0.01%, preferably 0.008%, and more preferably 0.006%. On the other hand, a severe reduction in the amount of N causes an increase in manufacturing costs, and inhibits the formation of Ti nitrides that are useful for trapping hydrogen. Therefore, the lower limit of the N content may be specified at 0.001%, preferably 0.002%, and more preferably 0.003%.

Besides the above-described essential element, if necessary, the steel of the present invention may further contain (a) elements for enhancing the corrosion resistance of the steel (e.g., Cu, Ni and the like); and (b) carbide/nitride forming elements (e.g., V, Nb and the like).

(a) The following will now describe the reason for specifying desirable contents of Cu and Ni elements and reasons thereof.

Cu: 0.7% or less (exclusive of 0%)

Cu is an element more electrochemically noble than Fe, and is useful for enhancing the corrosion resistance. Although the lower limit of the Cu content is not specified, the corrosion resistance is substantially enhanced when the Cu content is 0.05% or more, preferably 0.1% or more, and more preferably 0.2% or more. However, when the Cu content is excessive, the corrosion resistance effect is saturated, or rather, there is a fear of causing the embrittlement of the material during hot rolling. Therefore, the upper limit of the Cu content is preferably specified at 0.7%, preferably 0. 5%, and more preferably 0.4%.

Ni: 0.8% or less (exclusive of 0%)

Ni is an element which is useful not only for increasing toughness of a material after quenching and tempering, but also for improving the corrosion resistance by making the rust produced on the surface amorphous and dense. Although the lower limit of the Ni content is not specified, the effect is substantially enhanced when the Ni content is 0.15% or more, preferably 0.20% or more, and more preferably 0.25% or more. However, if the Ni content is excessive, quenchability (hardenability) is increased and a supercooling structure is produced in a rolled material. In addition, the amount of austenite residue increases and as a result, strength, especially stress of the steel that affects the spring properties, is deteriorated. Therefore, the upper limit of the Ni content is specified at 0.8%, preferably 0.7%, and more preferably 0.65%.

The steel of the present invention may contain both Cu and Ni, or one of the elements.

(b) The following will now describe the reason for specifying desirable contents of V and Nb elements and reasons thereof.

V: 0.4% or less (exclusive of 0%)

V is an element which forms fine precipitates composed of carbides and nitrides and thus, enhances hydrogen embrittlement resistance or fatigue properties of the steel, increases toughness or stress by refining the grain size, and improves the corrosion resistance or the sag resistance. Although the lower limit of the V content is not specified, these effects are substantially enhanced when the V content is 0.07% or more, preferably 0.10% or more, and more preferably 0.12% or more. However, when the V content is excessive, the amount of carbides of alloys not being dissolved in solid in the austenite phase during heating for quenching is increased, thereby making it difficult to obtain satisfactory strength and hardness. Therefore, the upper limit of the V content is specified at 0.4%, preferably 0.3%, and more preferably 0.2%.

Nb: 0.1% or less (exclusive of 0%)

Nb is an element which forms fine precipitates composed of carbides, nitrides, and sulfides and compounds thereof and thus, enhances hydrogen embrittlement resistance of the steel, and increases toughness or stress by refining the grain size. Although the lower limit of the Nb content is not specified, these effects are substantially enhanced when the Nb content is 0.01% or more, preferably 0.015% or more, and more preferably 0.020% or more. However, when the Nb content is excessive, the amount of carbides of alloys not being dissolved in solid in the austenite phase during heating for quenching is increased, thereby lowering the tensile strength. Therefore, the upper limit of the Nb content is specified at 0.1%, preferably 0.07%, and more preferably 0.05%.

The steel of the present invention may contain both V and Nb, or one of the elements.

In addition, the steel of the present invention may further contain other elements, and the balance may be essentially Fe and inevitable impurities.

The most outstanding characteristic of the steel of the present invention is that the amount of Ti forming Ti nitride, the amount of Ti forming Ti sulfide, and the amount of Ti forming Ti carbide satisfy the following formulas (1), (2), and (3) below:

$$[Ti_{with\ N}] \geq 3.42 \times [N] - 0.354 \times [Al] - 0.103 \times [Nb] \quad (1)$$

$$[Ti_{with\ S}] \geq 1.49 \times [S] \quad (2)$$

$$[Ti_{with\ C}] \geq 0.015 \quad (3),$$

in which $[Ti_{with\ N}]$ represents the amount of Ti (mass %) forming Ti nitride, $[Ti_{with\ S}]$ represents the amount of Ti (mass %) forming Ti sulfide, $[Ti_{with\ C}]$ represents the amount of Ti (mass %) forming Ti carbide, and [N], [Al], [Nb], and [S] represent an amount (mass %) of each element in the steel.

Regarding the formula (1):

As the amount of N increases (therefore, there is a higher possibility of having dissolved N residue), the formula (1) is not likely to be satisfied. But when the dissolved N is precipitated as Ti nitride, the formula (1) is easily satisfied. In other words, the formula (1) is a relational expression describing whether the dissolved N can be reduced by changing it into Ti nitride. To be more specific, the right side of the formula (1) reflects the influence of the nitride forming elements Al and Nb, and estimates the amount of free N being dissolved, not in the form of Al nitride or Nb nitride. When the dissolved N is replaced by Ti nitride to satisfy the relation shown in the formula (1), the resistance to hydrogen embrittlement of the steel is remarkably improved. FIG. 1 is a graph showing the relation between the formula (1) and hydrogen embrittlement resistance. As shown in the graph in FIG. 1, hydrogen embrittlement resistance sharply increases when the value of $[Ti_{with\ N}]-3.42N-0.354Al-0.103Nb$ is positive (+).

Figure 2:
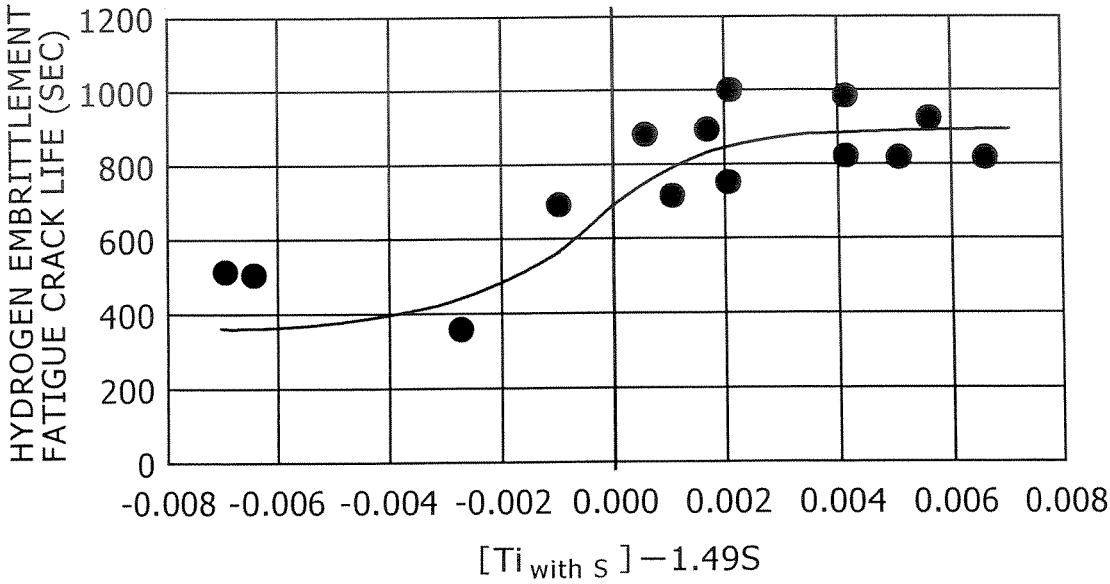
FIG. 2 is a graph showing a relation between a formula (2) and hydrogen embrittlement resistance.

Regarding the formula (2):

As the amount of S increases (therefore, there is a higher possibility of having dissolved S residue), the formula (2) is not likely to be satisfied. But when the dissolved S is precipitated as Ti sulfide, the formula (2) is easily satisfied. In other words, the formula (2) is a relational expression describing whether the dissolved S can be reduced by changing it into Ti sulfide. When the dissolved S is replaced by Ti sulfide to satisfy the relation shown in the formula (2), the resistance to hydrogen embrittlement of the steel is remarkably improved. FIG. 2 is a graph showing the relation between the formula (2) and hydrogen embrittlement resistance. As can be seen in the graph in FIG. 2, hydrogen embrittlement resistance sharply increases when the value of $[Ti_{with\ S}]-1.49S$ is positive (+).

Figure 3:
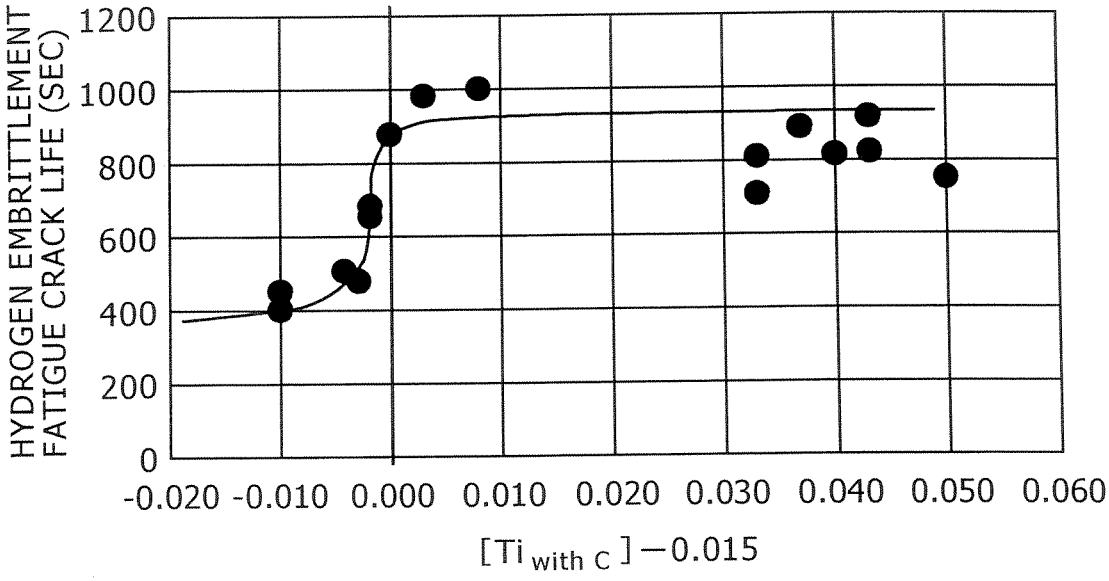
FIG. 3 is a graph showing a relation between a formula (3) and hydrogen embrittlement resistance.

Regarding the formula (3):

When all of Ti contained in the steel is consumed in Ti nitride or Ti sulfide, the original purpose of adding Ti for precipitating Ti carbides may not be fulfilled. If Ti carbides having superior effects on forming crystal grains or hydrogen trapping is insufficient, it is difficult to improve toughness or hydrogen embrittlement resistance of the steel. Thus, the formula (3) is satisfied by adding a sufficient amount of Ti. FIG. 3 is a graph showing the relation between the formula (3) and hydrogen embrittlement resistance. As evident in FIG. 3, hydrogen embrittlement resistance sharply increases when the value of $[Ti_{with\ C}]-0.015$ is positive (+) (that is, when the relation shown in the formula (3) is satisfied).

$[Ti_{with\ N}]$, $[Ti_{with\ S}]$, and $[Ti_{with\ C}]$ can be obtained by the steps of (i)-(v) as follows:

(i) A 0.4-0.5 g (mass) sample is cut and is digested in an electrolyte (ethanol solution containing 10 mass % acetylacetone) into which 100 mA current was applied for five hours. A base metal Fe is electrolyzed to collect precipitates in the steel (TiN, TiC, $Ti_4C_2S_2$ and a very small amount of TiS, AlN and the like) existing in the electrolyte as a remainder thereof. For a filter for collecting the remainder (residue), a membrane filter having a mesh diameter of 0.1 μm (for example, manufactured by Advantec Toyo Kaisha, Ltd.) is used. The remainder is put into 10 ml diluted acid (35 mass % of hydrochloric: water=1:3 (weight ratio)) to dissolve AlN, and is filtered again by the filter having a mesh diameter of 0.1 μm to recover a remainder (TiN, TiC, $Ti_4C_2S_2$ and a very small amount of TiS and the like; hereinafter referred to as a secondary remainder).

(ii a) The concentration of N (N*) in the secondary remainder is obtained by following the indophenol blue absorptiometric method of (JIS G1228 Appendix 3).

(ii b) The concentration of (compound type S concentration; S*) in the secondary remainder is obtained by following the hydrogen sulfide vaporization separation methylene blue absorptiometric method (JIS G1251 Appendix 7).

(ii c) The secondary remainder is dissolved in 4 mass % hydrochloric acid, and water therein is evaporated. Then, the concentration of Mn (compound type Mn concentration; Mn*) and the concentration of Ti (compound type Ti concentration; Ti*) are measured with an ICP emission spectrometer.

(iii) Having assumed that N exists in the form of TiN in the secondary remainder, the concentration of TiN in the secondary remainder is obtained based on the N concentration (N*), and $[Ti_{with\ N}]$ is then calculated therefrom.

In addition, the concentration of Ti ($Ti^*_{(TiN)}$) existing in the form of TiN in the secondary remainder is also obtained out of the concentration of N (N*) in the secondary remainder.

(iv) Having assumed that Mn exists in the form of MnS in the secondary remainder, the concentration of S ($S^*_{(MnS)}$) existing in the form of MnS in the secondary remainder is calculated out of the concentration of Mn (Mn*). Likewise, having assumed that the rest of S after subtracting S concentration existing in the form of MnS ($S^*_{(MnS)}$) from the S concentration (S*) in the secondary remainder, S ($S^*-S^*_{(MnS)}$), is used for forming $Ti_4C_2S_2$, the concentration of $Ti_4C_2S_2$ in the secondary remainder was obtained, and $[Ti_{with\ S}]$ was then calculated therefrom. In this calculation, it is assumed (in approximation) that TiS was not produced and all the sulfides obtained were $Ti_4C_2S_2$. However, since the amount of TiS produced in reality is extremely small, $[Ti_{with\ S}]$ calculated on the basis of the above-described assumption (in approximation) is not much different from the true value.

Moreover, the concentration of Ti existing in the form of $Ti_4C_2S_2$ in the secondary remainder, ($Ti^*_{(Ti4C2S2)}$) can be obtained out of the effective concentration of the remaining $S(S^*—S^*_{(MnS)})$ in the secondary remainder.

(v) Having assumed that the rest of Ti after subtracting Ti concentration existing in the form of TiN and $Ti_4C_2S_2$ from the Ti concentration (Ti*) in the secondary remainder, $Ti(Ti^*—Ti^*(TiN)—Ti^*_{(Ti4C2S2)})$, is used for forming TiC, the concentration of TiC in the secondary remainder is obtained, and $[Ti_{with\ C}]$ is then calculated therefrom.

To make $[Ti_{with\ N}]$, $[Ti_{with\ S}]$, and $[Ti_{with\ C}]$ satisfy the formulas (1)-(3), it is recommended to control the manufacturing process of spring steels that involve casting and hot-rolling a steel having specific compositions at predetermined ranges under conditions of (I)-(IV) as follows:

(I) In case of continuously casting steel, it is important to set the cooling rate at a temperature between 1500 and 1400° C. at 0.8° C./sec or less. By cooling the steel slowly at the temperature range of 1500 to 1400° C., free N or S is sufficiently fixed by Ti. The cooling rate is preferably 0.5° C./sec or less, and more preferably 0.4° C./sec or less. If the cooling rate is too low, however, coarse precipitates remain. Therefore, the cooling rate is preferably 0.05° C./sec or higher, more preferably 0.1° C./sec or higher, and more preferably 0.2° C./sec or higher.

(II) It is important to set the heating temperature (the highest temperature the steel can reach) of steel billets before hot-rolling to 1200° C. or above. By setting the heating temperature high enough, free N or S is well fixed by Ti. The heating temperature is preferably 1210° C. or above, and more preferably 1220° C. or above. If the heating temperature is set too high, however, coarse precipitates remain. Therefore, the heating temperature is preferably 1300° C. or below, more preferably 1290° C., and more preferably 1280° C.

(III) In general, water is sprayed over hot steel billets before carrying out a hot-rolling process, so as to descale the billets. More water may be sprayed to make sure that the hot rolling start temperature (the temperature right before rough rolling) is 950° C. or below. By setting the hot rolling start temperature low, it is possible to precipitate a sufficient amount of Ti carbides, and coarsening of precipitates can be prevented. In addition, it is equally important to set the hot rolling start temperature to 850° C. or above. This is because free N or S is well fixed by Ti if the hot rolling start temperature is not too low.

(IV) It is important that the cooling start temperature (Stelmor controlled cooling temperature) after the hot-rolling process is set to 950° C. or below, and that the cooling rate between the cooling start temperature and 700° C. is set to 20° C./sec or lower (preferably 15° C./sec or lower, and more preferably 10° C./sec or lower). If the cooling rate within this temperature range can be controlled to be not too high, a sufficient amount of Ti carbides can be precipitated. Moreover, if the cooling rate between 950° C. and 700° C. is too low, resulting precipitates become coarse. Therefore, the cooling rate is preferably 4° C./sec or higher, preferably 5° C./sec or higher, and more preferably 6° C./sec or higher.

Unless specified otherwise, the conventional manufacturing conditions can be used except for the above-described conditions.

The spring steel thus obtained shows excellent resistance to hydrogen embrittlement. In addition, since the spring steel of the present invention does not contain excessive amounts of Cr, Si, or Ni alloying elements, it offers superior workability. Further, the spring steel of the present invention has excellent tensile strength, for example, between 1800 and 2500 MPa, preferably between 1900 and 2300 MPa, and more preferably between 2000 and 2200 MPa.

EXAMPLE

While specific embodiments of the invention are described in detail to illustrate the inventive principles, it will be understood that the invention may be embodied otherwise without departing from such principles.

Experimental Example 1

80 tons of steel having compositions specified in Table 1 (test steel Nos. A-L) were melted and continuously casted to produce 430 mm×300 mm blooms. Table 2 shows cooling rates (solidifying rates) between 1400 and 1500° C. during continuous casting. Each bloom was forged and rolled in a billet of 155 mm×155 mm, and was then hot-rolled into a wire having a diameter of 13.5 mm under the conditions specified in Table 2 below. In addition, each rolled steel (Nos. 1-10) was examined to make sure that ferrite decarburization did not occur therein.

Applying a method of electrolytic extraction to the wires, $[Ti_{with\ N}]$, $[Ti_{with\ S}]$, and $[Ti_{with\ C}]$ were obtained.

Further, hydrogen embrittlement fatigue crack life was evaluated as follows.

[Hydrogen Embrittlement Fatigue Crack Life]

A wire was cut out to a proper length, and was heated at 925° C. for 10 minutes. The wire was then subjected to quenching with 70° C. oil, and was heated at 370° C. for 60 minutes and tempered, thereby being cut into a test sample of 10 mm (width)×1.5 mm (thickness)×65 mm (length). Next, for a low-temperature annealing simulation following the shot peening process, the test sample went through a low-temperature annealing process at 250° C. for 20 minutes.

While applying stress of 1400 MPa by 4-point bending, the test sample was pickled in a mixed solution of sulfuric acid (0.5 mol/L) and potassium thiocyanate (0.01 mol/L). Using a potentionstat, a voltage of −700 mV which is lower than SCE reference electrode was applied and the amount of elapsed time to crack generation was measured.

The evaluation results are shown in Tables 1 and 2.

TABLE 1

| Type of steel | Chemical composition (mass %; The balance is essentially Fe and inevitable impurities) | | | | | | | | | | | | | Right side of formula (1) (3.42N—0.354Al—0.103Nb) | Right side of formula (2) (1.49S) |
|---|---|---|---|---|---|---|---|---|---|---|---|---|---|---|---|
| | C | Si | Mn | Cr | P | S | Ti | Al | N | Cu | Ni | V | Nb | | |
| A | 0.60 | 2.23 | 1.00 | 1.75 | 0.013 | 0.012 | 0.050 | 0.025 | 0.0050 | — | — | — | — | 0.0083 | 0.018 |
| B | 0.39 | 1.79 | 0.17 | 1.06 | 0.002 | 0.006 | 0.068 | 0.027 | 0.0050 | 0.22 | 0.53 | 0.170 | — | 0.0075 | 0.009 |
| C | 0.41 | 1.75 | 0.18 | 1.05 | 0.005 | 0.005 | 0.030 | 0.025 | 0.0045 | 0.22 | 0.53 | — | — | 0.0065 | 0.007 |
| D | 0.48 | 2.08 | 0.18 | 1.06 | 0.003 | 0.004 | 0.075 | 0.029 | 0.0036 | 0.45 | 0.70 | 0.100 | — | 0.0020 | 0.006 |
| E | 0.45 | 2.10 | 0.17 | 1.44 | 0.003 | 0.005 | 0.070 | 0.031 | 0.0053 | 0.50 | 0.70 | — | — | 0.0072 | 0.007 |
| F | 0.48 | 2.10 | 0.19 | 1.12 | 0.007 | 0.005 | 0.072 | 0.032 | 0.0033 | 0.61 | 0.73 | — | 0.032 | −0.0033 | 0.007 |
| G | 0.47 | 1.97 | 0.74 | 0.18 | 0.010 | 0.004 | 0.078 | 0.030 | 0.0058 | 0.18 | 0.26 | 0.144 | — | 0.0092 | 0.006 |
| H | 0.43 | 1.92 | 0.15 | 1.04 | 0.004 | 0.004 | 0.074 | 0.031 | 0.0036 | 0.21 | 0.59 | 0.174 | — | 0.0013 | 0.006 |
| I | 0.42 | 1.88 | 0.15 | 1.04 | 0.010 | 0.010 | 0.078 | 0.032 | 0.0033 | 0.22 | 0.61 | 0.179 | — | 0.0000 | 0.015 |
| J | 0.42 | 1.89 | 0.16 | 1.03 | 0.015 | 0.015 | 0.079 | 0.028 | 0.0033 | 0.23 | 0.61 | 0.181 | — | 0.0014 | 0.022 |
| K | 0.42 | 1.94 | 0.16 | 1.04 | 0.019 | 0.019 | 0.078 | 0.029 | 0.0035 | 0.22 | 0.62 | 0.175 | — | 0.0017 | 0.028 |
| L | 0.42 | 1.94 | 0.16 | 1.04 | 0.026 | 0.024 | 0.079 | 0.028 | 0.0038 | 0.22 | 0.61 | 0.176 | — | 0.0031 | 0.036 |

TABLE 2

| No | Type of steel | Solidifying rate (° C./sec) | Heating temp before hot-rolling (° C.) | hot-rolling start temp (° C.) | Cooling start temp after hot-rollin (° C.) | Cooling rate down to 700° C. (° C./sec) | Ti with N (mass %) | Right side of formula (1) | Ti with S (mass %) | Right side of formula (2) | Ti with C (mass %) | Tensile strength (MPa) | H - embrittlement fatigue crack life (sec) |
|---|---|---|---|---|---|---|---|---|---|---|---|---|---|
| 1 | A | 0.2 | 1250 | 875 | 940 | 10 | 0.0092 | 0.0083 | 0.022 | 0.018 | 0.018 | 1987 | 985 |
| 2 | B | 0.1 | 1250 | 900 | 925 | 5 | 0.0091 | 0.0075 | 0.011 | 0.009 | 0.023 | 1941 | 1005 |
| 3 | C | 0.3 | 1280 | 875 | 930 | 5 | 0.0070 | 0.0065 | 0.008 | 0.007 | 0.015 | 1948 | 880 |
| 4 | D | 0.1 | 1210 | 900 | 945 | 4 | 0.0020 | 0.0020 | 0.008 | 0.006 | 0.065 | 2166 | 750 |
| 5 | E | 0.2 | 1250 | 875 | 950 | 10 | 0.0077 | 0.0072 | 0.014 | 0.007 | 0.048 | 2056 | 812 |
| 6 | F | 0.2 | 1210 | 875 | 940 | 10 | 0.0009 | −0.0033 | 0.013 | 0.007 | 0.058 | 2145 | 921 |
| 7 | G | 0.2 | 1240 | 900 | 920 | 5 | 0.0101 | 0.0092 | 0.007 | 0.006 | 0.048 | 2010 | 712 |
| 8 | H | 0.2 | 1225 | 900 | 910 | 7 | 0.0018 | 0.0013 | 0.011 | 0.006 | 0.055 | 2027 | 815 |
| 9 | I | 0.2 | 1280 | 900 | 875 | 6 | 0.0004 | 0.0000 | 0.019 | 0.015 | 0.058 | 2066 | 820 |
| 10 | J | 0.2 | 1300 | 900 | 950 | 10 | 0.0022 | 0.0014 | 0.024 | 0.022 | 0.052 | 2021 | 891 |
| 11 | A | 1.0 | 1250 | 900 | 900 | 8 | 0.0062 | 0.0083 | 0.020 | 0.018 | 0.016 | 1985 | 507 |
| 12 | A | 1.2 | 1100 | 900 | 950 | 5 | 0.0051 | 0.0083 | 0.023 | 0.018 | 0.021 | 2012 | 620 |
| 13 | B | 1.5 | 1120 | 875 | 940 | 20 | 0.0081 | 0.0075 | 0.002 | 0.009 | 0.048 | 1925 | 515 |
| 14 | D | 1.0 | 1150 | 890 | 945 | 10 | 0.0032 | 0.0020 | 0.005 | 0.006 | 0.025 | 2125 | 691 |
| 15 | E | 1.3 | 1150 | 940 | 850 | 10 | 0.0085 | 0.0072 | 0.001 | 0.007 | 0.054 | 2069 | 505 |
| 16 | E | 1.1 | 1180 | 830 | 875 | 10 | 0.0061 | 0.0072 | 0.012 | 0.007 | 0.051 | 2078 | 540 |
| 17 | A | 0.3 | 1250 | 970 | 950 | 10 | 0.0095 | 0.0083 | 0.022 | 0.018 | 0.011 | 1990 | 500 |
| 18 | E | 0.2 | 1250 | 960 | 950 | 10 | 0.0089 | 0.0072 | 0.015 | 0.007 | 0.005 | 2071 | 450 |
| 19 | C | 0.2 | 1250 | 900 | 880 | 30 | 0.0080 | 0.0065 | 0.009 | 0.007 | 0.012 | 1936 | 481 |
| 20 | D | 0.1 | 1280 | 920 | 890 | 25 | 0.0028 | 0.0020 | 0.009 | 0.006 | 0.013 | 2162 | 682 |
| 21 | F | 0.2 | 1240 | 920 | 900 | 25 | 0.0005 | −0.0033 | 0.011 | 0.007 | 0.005 | 2163 | 405 |
| 22 | K | 0.2 | 1210 | 910 | 940 | 5 | 0.0028 | 0.0017 | 0.031 | 0.028 | 0.013 | 2005 | 650 |
| 23 | L | 0.2 | 1250 | 900 | 910 | 6 | 0.0045 | 0.0031 | 0.033 | 0.036 | 0.019 | 2024 | 353 |

Dissolved N or dissolved S is not sufficiently changed into Ti nitrides or Ti sulfides in the following cases: in sample No. 11, because the solidifying rate is not low; in sample Nos. 12-15, because the solidifying rates are not low and the heating temperatures prior to hot-rolling are not high enough; and in sample No. 16, because the solidifying rate is not low, the heating temperature is not high, and the hot-rolling start temperature is too low, respectively. In consequence, these samples do not satisfy the relation in the formula (1) or (2) and therefore, each shows deteriorated resistance to hydrogen embrittlement.

In case of the sample Nos. 17-18, because the hot-rolling start temperatures are not set sufficiently low and sufficient amounts of Ti nitrides are not precipitated, they do not satisfy the relation in the formula (3) and show deteriorated resistance to hydrogen enbrittlement.

In case of the sample Nos. 19-21, because the cooling rates after hot-rolling are too high and sufficient amounts of Ti nitrides are not precipitated, they do not satisfy the relation in the formula (3) and show deteriorated resistance to hydrogen embrittlement.

In case of the sample Nos. 22-23, they contain an excessive amount of P or S, thereby showing deteriorated resistance to hydrogen embrittlement.

Unlike these above samples, the steels of the present invention (Nos. 1-10) had proper compositions and satisfied the relations in the formulas (1)-(3) and exhibited excellent resistance to hydrogen embrittlement.

Moreover, the influence of the formula (1) is depicted in FIG. 1, on the basis of data obtained from the samples (Nos. 11, 12, and 16) which do not satisfy the relation in the formula (1) and the steels of the present invention (Nos. 1-10); the influence of the formula (2) is depicted in FIG. 2, on the basis of data obtained from the samples (Nos. 13-15, and 23) which do not satisfy the relation in the formula (2) and the steels of the present invention (Nos. 1-10); and the influence of the formula (3) is depicted in FIG. 3, on the basis of data obtained from the samples (Nos. 17-22) which do not satisfy the relation in the formula (3) and the steels of the present invention (Nos. 1-10). As evident from FIGS. 1-3, hydrogen embrittlement resistance of a steel is remarkably enhanced when the relations in the formulas (1)-(3) are satisfied.

The spring steel or the steel wire (preferably, an oil temper steel) obtained from the spring steel of the present invention can be advantageously used in spring components (especially, automobile spring components), for example, a valve spring for use in an internal combustion engine, a clutch spring, a suspension spring, a stabilizer, a torsion bar and the like.

What is claimed is:

1. A spring steel, having a composition consisting essentially of:

C: 0.35-0.65%,
Si: 1.5-2.5%,
Mn: 0.05-1%,
Cr: 0.05-1.9%,
P: 0.015% or less (exclusive of 0%),
S: 0.015% or less (exclusive of 0%),
Ti: 0.0250.1%,
Al: 0.05% or less (exclusive of 0%),
N: 0.01% or less (exclusive of 0%),
Nb : 0.1% or less (exclusive of 0%);
optionally one or more of Cu, Ni, and V; and
a balance being Fe and inevitable impurities,
wherein said spring steel has a tensile strength of 2000 MPa or higher and a hydrogen embrittlement fatigue crack life of 712 sec. or higher, and an amount of Ti in Ti nitride, an amount of Ti in Ti sulfide, and an amount of Ti in Ti carbide satisfy following formulas (1), (2), and (3);

$$[Ti_{with\ N}] \geq 3.42 \times [N] - 0.354 \times [Al] - 0.103 \times [Nb] \quad (1)$$

$$[Ti_{with\ S}] \geq 1.49 \times [S] \quad (2)$$

$$[Ti_{with\ C}] \geq 0.015 \quad (3),$$

in which $[Ti_{with\ N}]$ represents the amount of Ti (mass %) forming Ti nitride, $[Ti_{with\ S}]$ represents the amount of Ti (mass %) forming Ti sulfide, $[Ti_{with\ C}]$ represents the amount of Ti (mass %) forming Ti carbide, and [N], [Al], [Nb], and [S] represent an amount (mass %) of each element in the steel; and the percentages above are mass percentages and wherein the steel is produced by a process comprising:

cooling a steel having the composition within the range from 1,500° C. to 1,400° C. at a rate of 0.8° C./sec or less;

setting the heating temperature of the steel to at least 1,200° C. but no more that 1,300° C.;

spraying water on the hot steel before carrying out a hot-rolling process until the steel reaches a temperature of 950° C. or below;

rolling the steel at a starting temperature of 850° C. or above, and cooling the steel after hot rolling at a starting temperature of 950° C. or less to a temperature of 700° C., at a rate of 20° C/sec or less.

2. The spring steel of claim 1, which further has at least one element selected from a group consisting of Cu: 0.7% or less (exclusive of 0%) and Ni: 0.8% or less (exclusive of 0%).

3. The spring steel of claim 1, which further has V: 0.4% or less (exclusive of 0%).

4. A steel wire obtained from the spring steel according to claim 1.

5. A spring obtained from the spring steel according to claim 1.

6. The spring steel of claim 1, wherein the content of Si is in a range of from 1.97 to 2.5%.

7. The spring steel of claim 1, having a content of Cu in a range of from 0.45 to 0.7 wt %.

8. A spring steel, having a composition consisting essentially of:

C: 0.47-0.65%,
Si: 1.7-2.5%,
Mn: 0.101%,
Cr: 0.051.9%,
P: >0.000%-0.015%,
S: 0.001%-0.015%,
Ti: 0.025-0.100%,
Al: 0.001%-0.05%,
N: 0.001-0.01%,
Nb: 0.02-0.05%;
optionally one or more of Cu, Ni, and V; and
a balance being Fe and inevitable impurities,
wherein said spring steel has a tensile strength of 2000 MPa or higher and a hydrogen embrittlement fatigue crack life of 712 sec. or higher, and said spring steel comprises a mass % of Ti nitride of:

$$[Ti_{with\ N}] \geq 3.42 \times [N] - 0.354 \times [Al] - 0.103 \times [Nb] \quad (1)$$

wherein said spring steel contains a mass % of Ti sulfide of:

$$[Ti_{with\ S}] \geq 1.49 \times [S] \quad (2)$$

wherein said spring steel contains a mass % Ti carbide of:

$$[Ti_{with\ C}] \geq 0.015 \quad (3),$$

wherein [N], [Al], [Nb], and [S] represent an amount (mass %) of each element in the steel and the percentages above are mass percentages, and wherein the spring steel is obtained by a process comprising:

cooling a steel having the composition within the range from 1,500° C. to 1,400° C. at a rate of 0.5° C./sec or less;

setting the heating temperature of the steel to at least 1,200° C. but no more that 1,300° C.;

spraying water on the hot steel before carrying out a hot-rolling process until the steel reaches a temperature of 950° C. or below;

rolling the steel at a starting temperature of 850° C. or above, and cooling the steel after hot rolling at a starting temperature of 950° C. or less to a temperature of 700° C., at a rate of 20° C./sec or less.

9. The spring steel of claim 8, which further has at least one element selected from a group consisting of Cu: 0.7% or less (exclusive of 0%) and Ni: 0.8% or less (exclusive of 0%).

10. The spring steel of claim 8, which further has V: 0.4% or less.

* * * * *